US005342218A

United States Patent [19]

McMills et al.

[11] Patent Number: 5,342,218

[45] Date of Patent: Aug. 30, 1994

[54] COAXIAL CABLE CONNECTOR WITH MANDREL SPACER AND METHOD OF PREPARING COAXIAL CABLE

[75] Inventors: Corey McMills, Los Altos; John S. Mattis, Sunnyvale, both of Calif.

[73] Assignee: Raychem Corporation, Menlo Park, Calif.

[21] Appl. No.: 994,061

[22] Filed: Dec. 17, 1992

Related U.S. Application Data

[63] Continuation of Ser. No. 673,717, Mar. 22, 1991, abandoned.

[51] Int. Cl.[5] ..... H01R 9/07

[52] U.S. Cl. ..... 439/578; 439/374

[58] Field of Search ..... 439/578–585, 439/675, 374, 378; 29/828

[56] References Cited

U.S. PATENT DOCUMENTS

| | | | |
|---|---|---|---|
| 3,486,216 | 12/1969 | Cimolino | 29/828 |
| 3,671,922 | 6/1972 | Zerlin et al. | 339/74 R |
| 3,697,930 | 10/1972 | Shirey | 339/89 C |
| 3,744,007 | 7/1973 | Horak | 339/97 R |
| 3,757,278 | 9/1973 | Schumacher | 439/585 |
| 3,781,762 | 12/1973 | Quackenbush | 339/89 C |
| 4,339,166 | 7/1982 | Dayton | 339/100 |
| 4,355,857 | 10/1982 | Hayward | 339/177 R |
| 4,540,231 | 9/1985 | Forney, Jr. | 439/585 |
| 4,583,811 | 4/1986 | McMills | 339/177 R |
| 4,600,263 | 7/1986 | De Champ et al. | 439/585 |
| 4,634,207 | 1/1987 | Debbaut | 339/116 C |
| 4,640,009 | 2/1987 | Liversidge | 29/828 |
| 4,643,924 | 2/1987 | Uken et al. | 428/35 |
| 4,701,574 | 10/1987 | Shimirak et al. | 174/93 |
| 4,721,832 | 1/1988 | Toy | 174/87 |
| 4,755,152 | 7/1988 | Elliot et al. | 439/452 |
| 4,834,675 | 5/1989 | Samchisen | 439/578 |

FOREIGN PATENT DOCUMENTS

| | | |
|---|---|---|
| 1946344 | 3/1971 | Fed. Rep. of Germany . |
| 363472C1 | 11/1987 | Fed. Rep. of Germany . |
| WO84/04003 | 10/1984 | PCT Int'l Appl. . |
| WO90/15454 | 12/1990 | PCT Int'l Appl. . |
| WO90/14697 | 11/2990 | PCT Int'l Appl. . |

OTHER PUBLICATIONS

Bunker Ramo Corp. Oct. 1980, Harold A. Hutter et al pp. 79–84.

*Primary Examiner*—David L. Pirlot

*Attorney, Agent, or Firm*—Herbert G. Burkard; A. Stephen Zavell

[57] ABSTRACT

The invention describes a method of preparing a cable, a coaxial cable mandrel guide/spacer, and a plurality of coaxial cables capable of accepting flexible coaxial cable without the requirement or folding back the conductive shielding braid material to form a connection to the cable. The guide/spacer is also useful with other nonbraided type connectors to avoid the need for a multilevel stripping of the coaxial cable. Avoiding the need for braid rollback eliminates a potential leak path and creates an improved sealed connector.

14 Claims, 6 Drawing Sheets

COAXIAL CABLE CONNECTOR WITH MANDREL SPACER AND METHOD OF PREPARING COAXIAL CABLE

This application is a continuation of application Ser. No. 07/673,717 filed Mar. 22, 1991 now abandoned.

CROSS-REFERENCE TO RELATED APPLICATIONS

This invention relates to coaxial cable connectors including an internal mandrel spacer and method of preparing coaxial cable. More specifically, this invention relates to F-drop size coaxial cable connectors and a method of preparing flexible coaxial cable for insertion into a connector without braid rollback.

BACKGROUND OF THE INVENTION

Coaxial cables generally comprise a center conductor surrounded by an insulating dielectric material such as plastic foam which is in turn surrounded by one or more layers of thin metal foil or wire braid to provide shielding with an outer jacket of a flexible insulating material such as polyethylene plastic. The preparation of such flexible cables for coaxial cable connectors generally requires a multiple step operation where the outer plastic jacket is cut back from the end of the cable a greater distance along the longitudinal axis than either a first or subsequent cut which removes the metal shielding and interior insulation to expose a portion of the central conductor core. Thereafter, the wire braid is folded back over the outer jacket and the cable is terminated within a cable connector by crimping or an outer back shell squeezing the cable within a ferrule, and the like. Suitable examples of connectors requiring this preparation are described in U.S. Pat. Nos. 4,583,111 and 4,834,675 as well as PCT application WO90/15454 (based upon U.S. Ser. Nos. 364,917 now abandoned; 434,068 now abandoned; and 509,669 Pat. No. 5,127,853 filed Jun. 8, 1989, Nov. 8, 1989, and Apr. 19, 1990, respectively). Each of these patents and applications is incorporated herein by reference for all purposes.

The preparation of the flexible coaxial cable for use in the previously described connectors generally involves a dual blade cable preparation tool wherein the blade to expose the center conductor is a notched blade to avoid scratching or severing the conductor. The second straight edge blade spaced apart from the notched blade cuts the cable to a shallower depth to peel off the outer most protective insulating jacket. The spacing of the blades both along the longitudinal axis as well as perpendicular to the longitudinal axis must be tightly controlled for proper cable preparation and to maintain the quality of any transmitted signal. An alternate but less precise preparation method is to use a knife. However, this often results in a nicked center conductor or loss of outer braid shielding wires.

It would be highly desirable to have a preparation tool which can remove the outer jacket as well as the outer shielding and interior foam while avoiding the tight tolerances necessary to preclude nicking or cutting the center conductor. It would also be desirable to have a connector which can terminate to the coaxial cable without the need to peel back the outer braid, i.e., the cable is prepared by a perpendicular cutting ±45° from the perpendicular to expose the center conductor without a separate removal of the outer jacket to expose braid. It would also be desirable to have a connector which guides the center conductor and dielectric upon installation to avoid bending or kinking of the center conductor or damage to the center dielectric. It would be further desirable to have an article which can modify available tubular mandrel connectors to use the simplified cable preparation procedures while making a termination to the coaxial cable.

SUMMARY OF THE INVENTION

The method of preparation, central mandrel conductor guide/spacer and connectors including the guide/spacer possess at least one or all of the previously cited desirable features as well as many other benefits obvious to the ordinary skilled artisan.

The slideable insulating center mandrel conductor guide/spacer fits within a hollow central mandrel and guides the central conductor wire therethrough by the urging of the prepared cable against the center guide/spacer. The center conductor is exposed by a stripping tool having an off-center blade to avoid nicking the center conductor which prepares the cable by cutting through the outer protective jacket and the outer wire braid and foil shields as well as the innerdielectric. Thereafter, any remaining dielectric is cleaned away from the central conductor by urging the center conductor through an interference fit hole either in the preparation tool and/or the center conductor guide/spacer.

BRIEF DESCRIPTION OF THE DRAWING(S)

DESCRIPTION OF THE PREFERRED EMBODIMENTS

Figure 1:
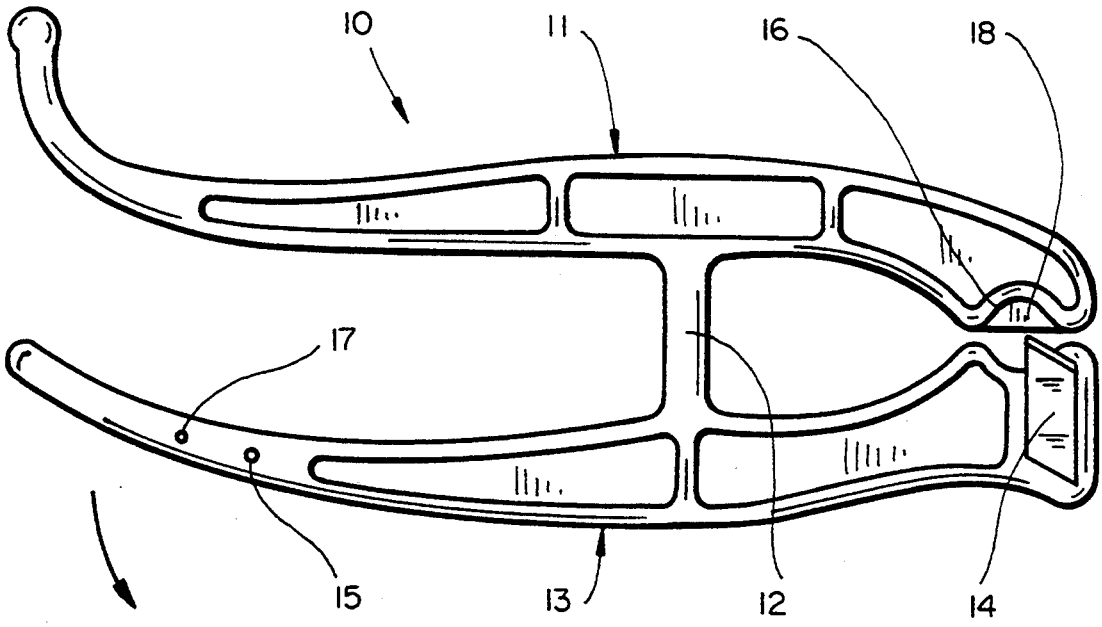
FIG. 1 illustrates a side view of an embodiment of a stripping tool of the invention useful in conjunction with the various other embodiments of the invention.

The invention and its preferred embodiments will be described in conjunction with the Figures. FIG. 1 illustrates an embodiment of a stripping tool 10 of the invention. The tool 10 is preferably fabricated from a single piece of material capable of exhibiting hinge-like properties of the cross-bracing member 12 connecting opposed handle members 11 and 13, respectively. Suitable materials are glass-filled plastic resins, polycarbonate, rigid polypropylene, and the like. Handle member 11 includes a "V" or "U" shaped coaxial cable centering member 16 and a stop means 18, generally a plastic barrier for the cable to position it at the appropriate depth across the width of the handle 11 to expose the predetermined amount of center conductor after cutting. The opposite end of the handle 11 includes a curved portion to facilitate the finger assisted rotation of the tool 10 as illustrated by the arrow. Opposed handle 13 includes an off-center cutting blade 14 to cut through the outer and inner insulation and the outer shielding of the coaxial cable.

The stripping tool 10 is preferably molded in one piece with the blade 14 either molded during this operation or heat-staked into place upon fitting into an appropriate receptacle for the blade after molding by melting the surrounding material over the blade 14. Optionally, the tool 10 can accommodate a replaceable blade insert. In preferred embodiments, the tool also includes to holes 15 and 17 sized to accept the center conductors to be used in the stripping tool with an interference fit to assure complete stripping of any remaining adhesive and insulation on the center conductor.

The tool is operated by urging the two handles towards each other to open the opposite end containing the "V" or "U" shaped cable centering guide 16 and the blade 14 while inserting the cable to abut against the plastic stop means 18. Thereafter, the tool 10 is rotated preferably in a direction as indicated in the arrow to cut through and strip away the outer and inner dielectric and the outer shielding. Upon several rotations of the stripping tool, the tool is pulled along the longitudinal axis of the cable away from the cable end to remove the cut cable layers. Finally, the center conductor may optionally be inserted into the appropriately sized hole 15 or 17.

Figure 2:
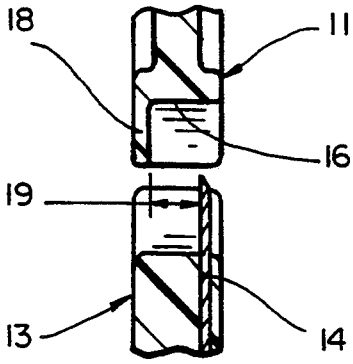
FIG. 2 illustrates an end on view of the stripping tool.
Figure 3:
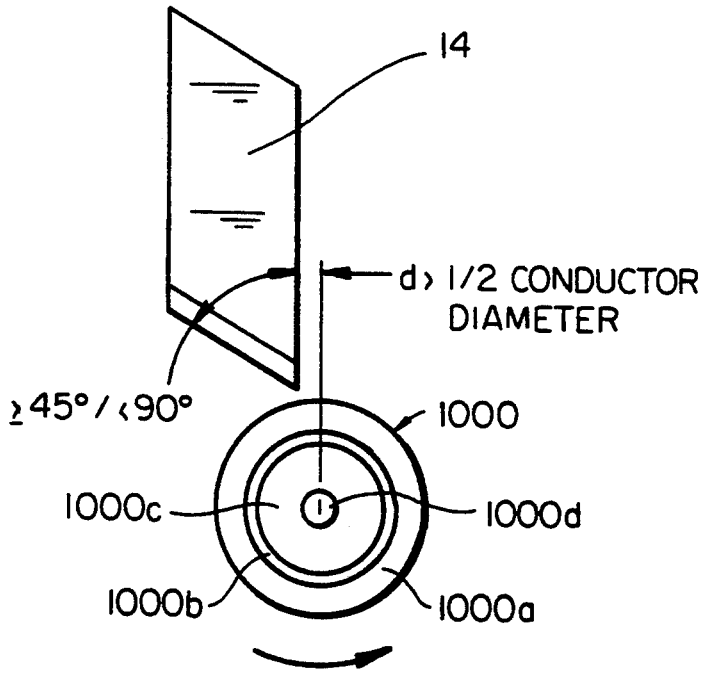
FIG. 3 illustrates a blade view blowup of the stripping tool with its off-center axis placement to avoid nicking the center conductor.

FIGS. 2 and 3 illustrate the off-center placement of the blade both from the longitudinal axis of the center conductor as well as within the stripping tool to provide a suitable length of center conductor as determined by the distance from the blade 14 to the stop means 18 and illustrated as the dimension 19 in FIG. 2. Of course, this distance is preferably optimized for a particular connector. In the preferred embodiment, the tool rotates as illustrated in FIG. 3 so that the straight angle of the cutting blade is substantially parallel to a plane bisecting the center conductor but parallel to and displaced from the conductor. The blade cuts through the outer and inner dielectric and outer shield. The blade preferably has an angle of 60° but can vary from 45° to 90°, i.e., the blade can be rectangular. The blade is offset a distance d which is sufficient to clear the center conductor, i.e., $>\frac{1}{2}$ the diameter of the center conductor. In the illustrative example, for RG59 and RG6 cable, the largest center conductor is approximately 0.040 inches in diameter and thus the blade is displaced somewhat greater than 0.22 inches. The vertical placement of the blade is not critical and can be somewhat greater or lesser than the placement of the conductor in the centering guide. It is generally preferred that the depth of the blade be somewhat adjacent the conductor in depth. Any suitable blade such as a steel is acceptable in the invention provided it cleanly cuts the dielectric and shielding materials.

Figure 4:
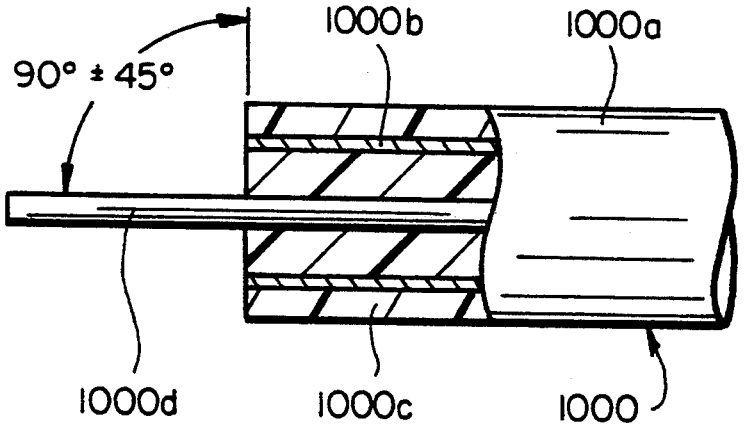
FIG. 4 illustrates a coaxial cable prepared with the stripping tool illustrated in FIG. 1.

FIG. 4 illustrates a prepared cable 1000 with the outer dielectric 1000*a* and outer shielding 1000*b* and inner shielding 1000*c* removed. For the preferred embodiments, the angle between the end of the stripped away materials and the center conductor is about 90° but it can vary ±45° provided that the mandrel guide/spacer is sized to accept the prepared end of the cable. Conical angles somewhat greater than 90°, i.e., like a sharpened pencil, provide a certain centering benefit within the reciprocal conical insert section of the center conductor guide/spacer but also provide somewhat less pushing surface area to move the guide/spacer through the mandrel upon the insertion of the prepared cable 1000 into the conductor guide/spacer.

Figure 5:
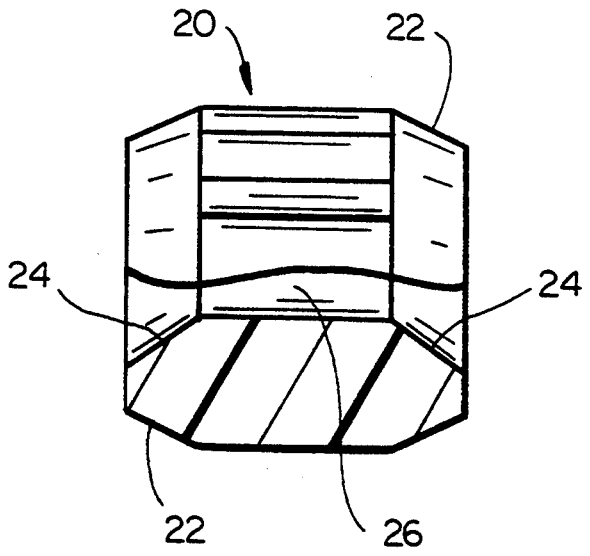
FIG. 5 illustrates a side view in partial cross-section of a preferred embodiment for an internal mandrel center conductor guide/spacer of the invention.
Figure 6:
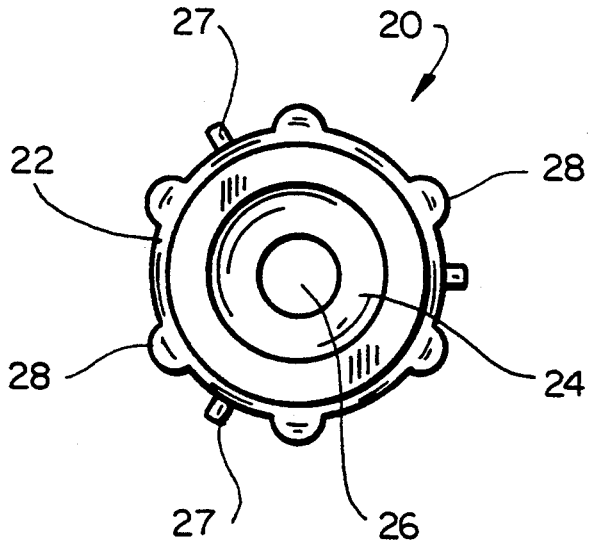
FIG. 6 illustrates an end view of the internal guide/spacer.

FIGS. 5 and 6 illustrate a particularly preferred guide/spacer shape illustrated as guide/spacer 20. The guide/spacer is sized and fabricated from any suitable dielectric insulating material with sufficient lubricity to move through the center bore of the mandrel upon the insertion of the cable without forcing a kinking of the cable or movement in the mandrel prior to cable insertion. Suitable materials are Teflon®, fluorinated polymeric plastics, polyethylene, polypropylene, and the like. The guide/spacer 20 includes an outer chamfer or bevel 22 sized to facilitate the placement of the guide/spacer 20 within the center of the tubular mandrel. The guide/spacer 20 further includes an inner conical chamfer 14 to help guide the center conductor 1000*d* therethrough. The hole or passage 26 in the guide/spacer 20 is sized to accept the center conductor with an interference fit to assure a cleaning of the center conductor as well as to provide friction to help drive the spacer through the mandrel during the insertion of the cable.

Optionally, as illustrated in this preferred embodiment, the center guide/spacer 20 further includes several exterior lobes 28 to minimize the overall surface contact between the mandrel spacer and the interior of the mandrel to avoid excessive friction. The guide/spacer 20 with at least one exterior bevel for mandrel insertion and at least one interior conical chamfer facing the conductor can have any suitable shape such as conical, triangular, square, rectangular, circular lobed, cylindrical, polygonal sided, and the like. Additionally, thin tabs 27 slightly longer than the lobes can locate the guide/spacer partially outside the mandrel prior the cable insertion and by folding over upon insertion provide a stabilizing means to avoid plastic creep of the guide/spacer upon thermal cycling.

Figure 7:
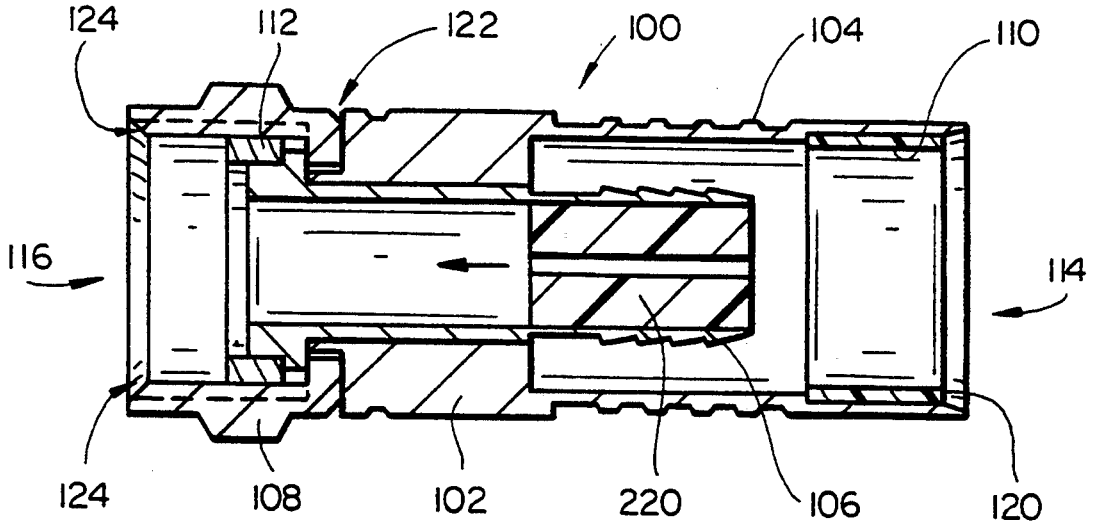
FIG. 7 illustrates the guide/spacer in what can be considered a standard crimp connector.

FIGS. 7 through 12 illustrate the center mandrel conductor guide/spacer in various types of connectors which to permit the use of a prepared cable without the need for braid foldback and to create various connector embodiments of the invention. FIG. 7, also described in U.S. Pat. No. 4,834,675, illustrates a crimp connector including the guide/spacer 220 to render the connector with the unique attributes of the invention. More specifically, the cable connector 100 comprises a connector body 102 which includes an annular collar member 104, a tubular post mandrel member 106, coaxially disposed within the collar member 104, and nut member 108 circumferentially disposed about the tubular post member 106. The connector 100 also includes a jacket seal 110 disposed around the inner periphery of the collar member 104 and a face seal 112 immediately disposed between the outer surface of the tubular post mandrel member 106 and the inner surface of the nut member 108. The connector additionally includes the mandrel spacer 220 at the insertion end of the connector prior to the insertion of the cable 1000. The mandrel spacer 220 will move to the front of the connector, i.e., the end connecting the conductor to a tap port or cable splice, and the like, as illustrated by the arrow, upon the insertion of the prepared cable therein.

Figure 8:
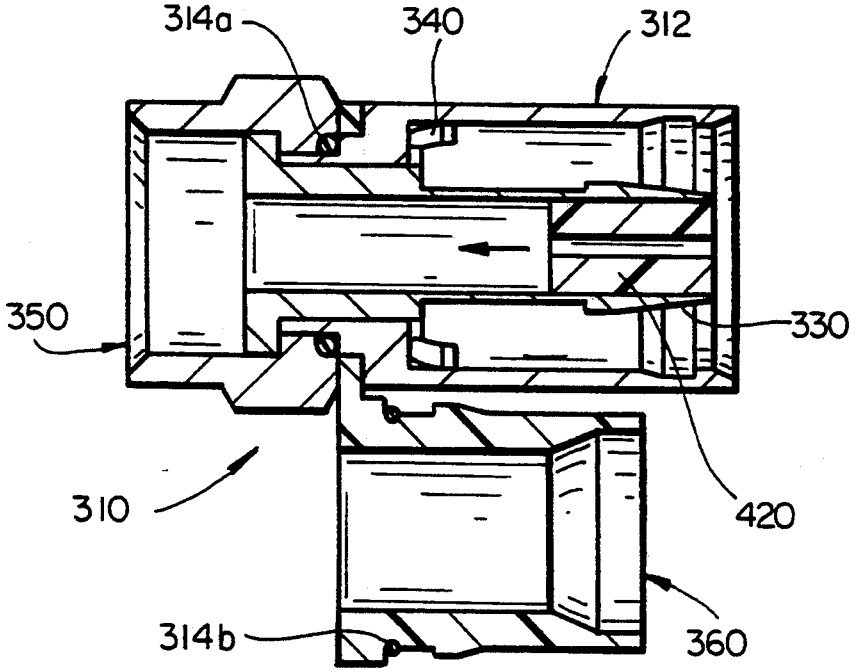
FIG. 8 illustrates the guide/spacer in a connector known as a Snap-n-Seal TM connector.

FIG. 8, also more particularly described in U.S. Pat. No. 4,834,675, describes a Snap-n-Seal TM Connector including the guide/spacer 420 of the invention to obviate the need for a prepared cable with braid foldback and to create an embodiment of the invention. More specifically, the connector 310 for the prepared coaxial cable 1000 includes a connector body 312, a compression sleeve 360, and an optional sealing nut, not illustrated. The connector body 312 includes an annular collar member 320, an annular tubular post mandrel member 330, including the guide/spacer 420, and an annular contact spring member 340, an annular nut member 350, and an annular sealing member 314*a*. The nut member 350 connects to a cable splice or tap port and the like. Upon installation of the connector, the prepared cable is inserted through the small end of the compression sleeve 360 and thereafter urged into the connector 310. In the process of the urging forward of the cable and sleeve, the guide/spacer 420 is urged to the front of the connector to guide the center conductor, prevent bending, and provide an additional seal for the connector.

Figure 9:
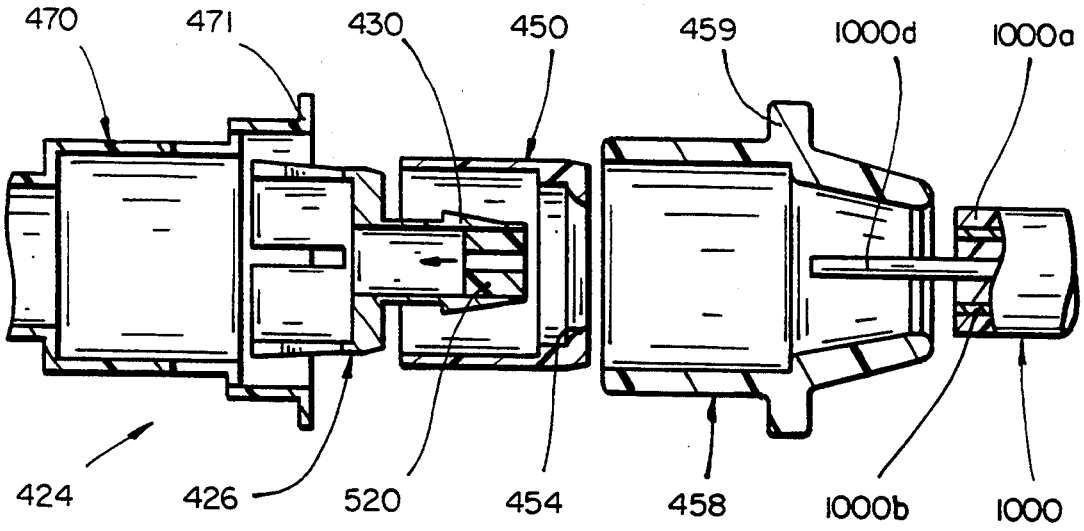
FIG. 9 illustrates the spacer in a connector known as EZ-Twist TM Connector.
Figure 10:
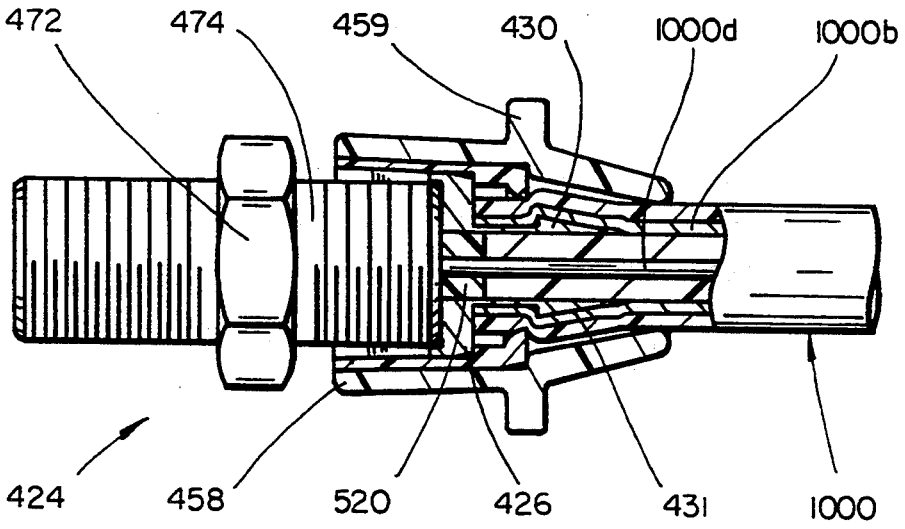
FIG. 10 illustrates an EZ-Twist TM Connector installed on a cable attached to a cable port with the guide/spacer in the forward position.
Figure 11:
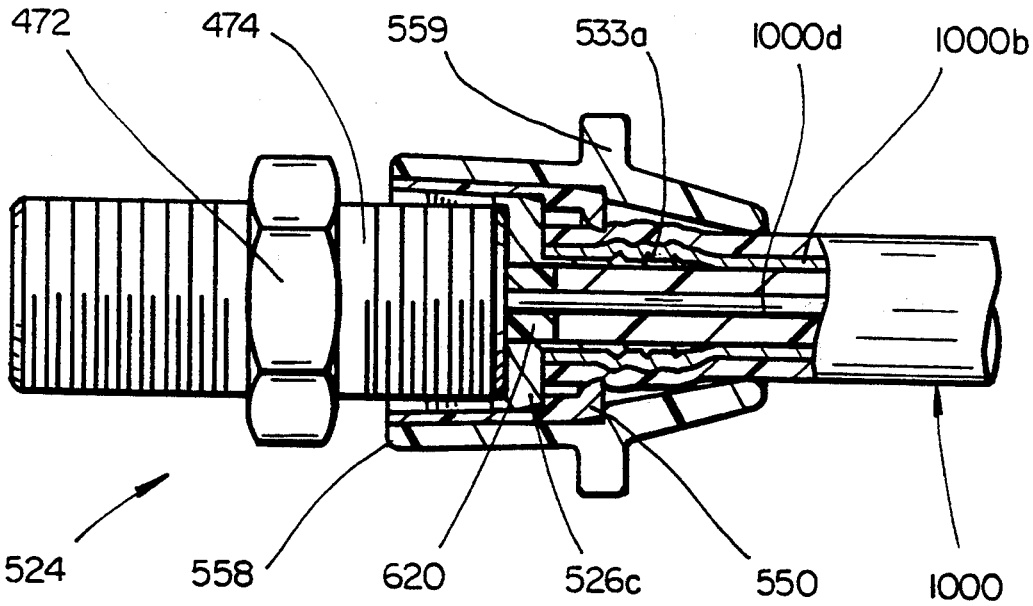
FIG. 11 illustrates an alternative and preferred embodiment of an EZ-Twist TM Connector with a tubular screw-like mandrel including the guide/spacer in the forward installed position.

FIGS. 9, 10, and 11 illustrate the guide/spacer both before insertion of the cable 1000 and upon seating of the cable in several of the most preferred embodiments connectors of the invention. These embodiments are described in substantially greater detail in the previously mentioned PCT Application WO90/15454 as well as the previously recited US applications. More specifically, FIGS. 9 and 10 illustrate the cable both before and after insertion into the EZ-Twist TM Connector embodiment including the knife edge tubular mandrel. FIG. 11 illustrates the prepared cable installed in a particularly preferred embodiment having the helical, i.e., screw, tubular central mandrel.

For clarity, FIGS. 9 and 10 should be reviewed together. A prepared cable 1000 with an appropriate length of exposed semiconductor 1000*a* and the inner dielectric and shielding layers 1000*b* and 1000*c* stripped away substantially perpendicular ±45° to the longitudinal axis will be inserted through the outer shell 458 and installation flanges 459 and through the cap 450 and guided into the tubular knife edge central mandrel 430 of the tubular mandrel body 426. The tap port/splice connector portion of the mandrel 426 optionally has fingers to flex over the tap port. The outer shell 458 and the cap 450 cooperate together upon forward movement to compress the tap side of the mandrel 426 upon tap a port or as illustrated a cable splice connector 472. The tap will have substantially the same dimensions as the threaded surface 474 of the cable splice connector 472 illustrated in FIG. 10. The installation aide 470 further includes an annular ring portion 471 to provide a convenient grip location for the users fingers. The cable is gripped in one hand and the assembly tool 470 containing the body 426, cap 450, and outer shell 458 is gripped in the other hand. Then the cable is pushed towards the tool 470 and into and through the outer shell 458 and the cap 450 to urge the connector guide/-spacer 520 forward. Then the cable engages the guide/-spacer 520 in the mandrel body 426, it pushes the guide/spacer 520 forward and away from the cap 450 and the outer shell 458. Optionally, with the new prepared cable end and conductor guide/spacer, the coaxial cable can be assembled on the splice connector 472 or a tap port.

FIG. 11 illustrates a particularly preferred embodiment of the invention incorporating a helically wound screw-like tubular member 526*c* having spiral helices 533*a* with the cap member 550 and the outer shell 558 with the installation assisting flanges 559. In this most preferred embodiment, the mandrel body 526*c* inwhich the frustoconical knife-blade edge 430 of the prior embodiments is replaced by a knife-blade helical thread or edge 533*a* projecting radially outward from the thin tubular region 528. In one practical example, the thin tubular region may be slightly frustoconical and have an average outside diameter of about, 0.180 inch. The helical knife edge 533*a* has apex which is approximately 0.210 inch and is formed as an acutely angled projection extending form the tubular region 528. The helical knife-blade 533*a* is so shaped as to bite sufficiently into the final aluminum strands of the outer conductor braid or aluminum foil to obtain a positive electrical contact with the foil and to provide a positive mechanical securement therewith without causing the strands to shear off or break.

An effective compromise between sharpness and dullness of the knife edge 533*a* is to make it flat across about 2–3 mil. A 1 mil flat is too sharp and will result in shearing the fine wire braid while an 8 mil radius at the edge is found to be too dull with the result in slippage of the braid under tension. Ideally, the knife edge blade 533*a* should subject the braid wires to shear stress without actually resulting in shearing them off. In practice, the compromise is reached by considering sharpness of the knife edge 533*a* and the hardness of the material of which it is made in conjunction with the strength of the braided strands.

Figure 12:
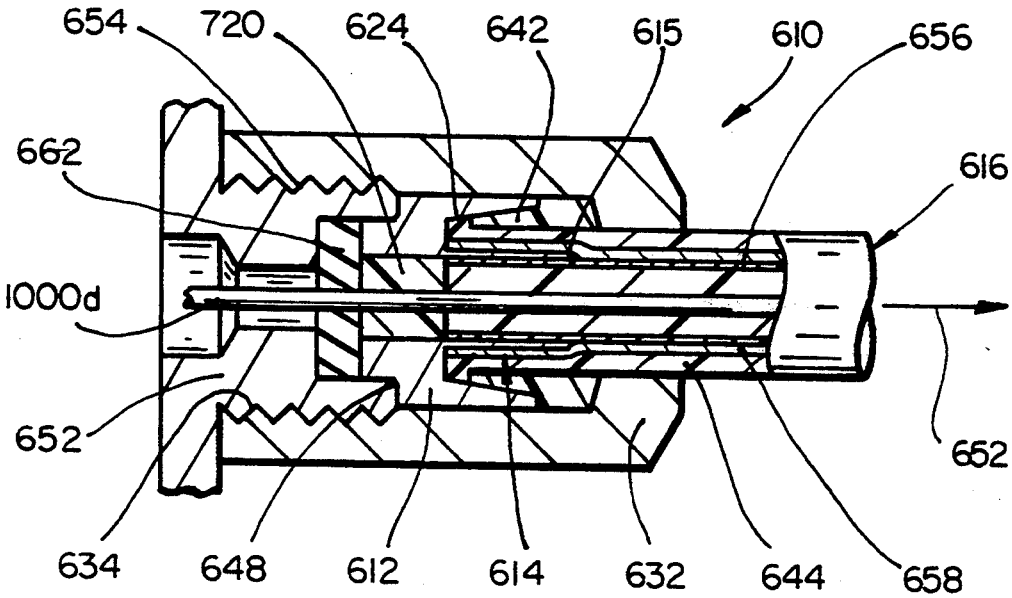
FIG. 12 illustrates a cross-sectional view of a connector known as EZF ® Connector installed with guide/spacer in the forward position.

FIG. 12 illustrates the invention of the guide/spacer 720 included in an F-drop coaxial cable connector known as EZF® Connector and more particularly described in U.S. Pat. No. 4,583,811. The connector is illustrated in its installed position with the guide/spacer 720 at the head of the mandrel portion of the connector when the tightening nut 610 is engaged on a cable splice or tap port 652. More specifically, the connector 610 includes the connector body 612 having a mating area 614 and a driver means 632 having threads 634 and rear face 640 and a compressive member 642. The connector 610 is connected to a wall mounting unit 652, e.g., a tap box, through the threads 654 which is typical for flexible F-type connector cables. For this type of cable, it is necessary to separate the delicate foil shielding and braided layers, 656 and 658, respectively. The connector body 612 includes a mating area 614 for contacting the braid and a distal end 615 which is sharpened to wedge between the delicate foil 656 and the braid 658.

The use of the conductor guide/spacer in the preferred embodiments described, especially FIGS. 9 through 12, as well as any other connector normally requiring a braid rollback, avoids the leak paths generated by poor sealing around the wire braid. This use of the invention permits the creation of a plurality of better sealed connectors.

The invention has been described with respect to particularly preferred embodiments which illustrate its ability to terminate a flexible braided F-drop style cable such as RG59 or RG6 without the need for braid foldback. Modifications, which would be obvious to the ordinary skilled artisan, are contemplated to be within the scope of the invention. For example, the cable and tap sides of the guide/spacer can be filled with a suitable gel dielectric material as described in U.S. Pat. Nos. 4,634,207; 4,634,924; 4,721,832; and 4,701,574, the disclosures of which are hereby incorporated by reference for all purposes. More specifically, suitable gels can be silicones, polyureas, polyurethanes, thermoplastic elastomer materials such as Kraton ®, and the like having a cone depression value of between about 75 to 350 ($10^{-1}$ mm) as measured by ASTM D217 and an ultimate elongation of about 100% as measured by ASTM D638. Additionally, the guide/spacer will find uses in tubular mandrel type connectors for stiff jacketed transmission coaxial cable.

What is claimed is:

1. A coaxial cable connector for forming a connection to a flexible coaxial cable having at least one outer shielding layer of conductive braiding material, the coaxial cable is prepared to have an exposed center conductor and a substantially perpendicular ±45° angle of cable materials away from the center conductor by the removal of the inner and outer dielectric and the outer shielding material, the center conductor comprises a section of the connector capable of forming a contact to a cable splice or cable tap port and a section opposite thereto including a tubular mandrel for contacting the cable, the tubular mandrel including a centrally located dielectric conductor guide/spacer capable of fitting within the mandrel, the guide/spacer capable of moving through the tubular mandrel towards the section of the connector contacting the cable splice or cable tap port upon the insertion of the cable conductor through the guide/spacer and into the connector, the dielectric conductor guide/spacer includes a conical entrance for the cable conductor to facilitate the passage of the central conductor therethrough and a beveled surface opposite thereto on a peripheral portion of the dielectric conductor guide/spacer to assist insertion into the tubular mandrel; and a securing means for securing the cable around the tubular mandrel.

2. The connector according to claim 1 wherein the connector is selected from a group of tubular mandrel connectors consisting of coaxial crimp connectors, coaxial connectors including compression sleeve members, and coaxial connectors including a central helical knife edge mandrel.

3. The connector according to claim 1 wherein the guide/spacer is a plastic material.

4. The connector according to claim 3 wherein the guide/spacer has outer lobes providing an interference fit with the mandrel and a central hole sized to provide an interference fit with the center conductor.

5. The connector according to claim 4 wherein the guide/spacer has a shape selected from the group consisting of conical, polygonal, square, cylindrical rectangular, lobed circular, or triangular.

6. The connector according to claim 5 further including a gel sealing material on at least one side of the guide/spacer abuting either the coaxial cable, or the cable splice or tap port.

7. The connector according to claim 6 including gel sealing means on both sides of the guide/spacer.

8. The connector according to claim 1 wherein the cable is prepared to have an exposed center conductor and a substantially perpendicular angle of the cable materials away from the center conductor by the removal of the inner and outer dielectric and the shielding material.

9. The connector according to claim 8 wherein the outer edges of the guide/spacer are chamfered and the guide/spacer includes conical facing entrance and exit portions for the cable conductor.

10. A coaxial cable center conductor guide/spacer capable of fitting into a tubular coaxial cable mandrel to obviate the requirement of shielding brain rollback of a prepared coaxial cable having an exposed center conductor, the guide/spacer comprising:

a dielectric shape of material sized to fit within a tubular cable mandrel, the shape having at least one outer chamfered portion to facilitate the insertion into the tubular mandrel and at least one centrally located conical portion opposite thereto but in communication with a central passage to assist the insertion of the center cable conductor into and through the central passage in the shaper of material, the dielectric shape of material further including tab members to assist the retaining of the shape of material in the mandrel, the tab members providing an outer diameter of the dielectric shape of material which is initially greater than the inside diameter of the mandrel, the tabs members fold over upon insertion of the dielectric shape of material into the mandrel to provide a stabilizing means to avoid creep of the guide/spacer.

11. The article according to claim 10 further including a second chamfered outer portion opposite to the at least one outer chamfered portion.

12. The article according to claim 11 further including a second centrally located conical portion opposite to the at least one centrally located conical portion and in communication with the passage.

13. The article according to claim 12 wherein the shape of material is cylindrical with a plurality of lobes to provide an interference fit with the tubular mandrel and the central passage is sized to provide a cleaning action by interference fit with the center cable conductor.

14. The article according to claim 13 wherein the tab members between at least two of the lobes to assist the retaining of the shape of material in the mandrel, the tabs being greater in length than the lobes.

* * * * *

UNITED STATES PATENT AND TRADEMARK OFFICE

CERTIFICATE OF CORRECTION

PATENT NO. : 5,342,218

DATED : August 30, 1994

INVENTOR(S) : McMills et al.

It is certified that error appears in the above-indentified patent and that said Letters Patent is hereby corrected as shown below:

Column 4, line 51, delete "which".

Column 8, line 19 Claim 10, delete "brain" and insert--braid--.

Column 8, line 29 Claim 10, delete "shaper" and insert--shape--.

Signed and Sealed this

Twenty-ninth Day of November, 1994

*Attest:*

Bruce Lehman

BRUCE LEHMAN

*Attesting Officer*

*Commissioner of Patents and Trademarks*